US005809600A

United States Patent [19]

Cachot

[11] Patent Number: 5,809,600

[45] Date of Patent: Sep. 22, 1998

[54] MUTIFUNCTIONAL TOOL ABLE TO RECEIVE REMOVABLE ATTACHMENTS

[75] Inventor: Maurice Cachot, Delémont, Switzerland

[73] Assignee: Wenger SA, Delemont, Switzerland

[21] Appl. No.: 775,888

[22] Filed: Jan. 2, 1997

[30] Foreign Application Priority Data

Jan. 5, 1996 [EP] European Pat. Off. ..... 96810003

[51] Int. Cl.[6] ..... B25B 7/22

[52] U.S. Cl. ..... 7/128; 81/180.1; 81/177.5

[58] Field of Search ..... 81/177.1, 177.5, 81/180.1, 184, 437, 438; 87/489, 125, 127; 7/128, 439

[56] References Cited

U.S. PATENT DOCUMENTS

| | | | |
|---|---|---|---|
| 2,950,746 | 8/1960 | C. M. Towne | 81/177.1 |
| 4,512,051 | 4/1985 | Magan | 7/128 |
| 4,519,278 | 5/1985 | Heldt | 81/180.1 |
| 4,960,016 | 10/1990 | Seals | 81/177.4 |
| 4,967,435 | 11/1990 | Seals | 7/139 |
| 5,186,083 | 2/1993 | Hsiao | 81/439 |
| 5,251,353 | 10/1993 | Lin | 7/128 |
| 5,320,004 | 6/1994 | Hsiao | 81/440 |
| 5,450,774 | 9/1995 | Chang | 81/440 |
| 5,528,963 | 6/1996 | Wei | 81/438 |
| 5,711,194 | 1/1998 | Anderson et al. | 81/440 |

FOREIGN PATENT DOCUMENTS

| | | | |
|---|---|---|---|
| 9403314 | 4/1995 | Germany | 81/440 |
| 583611 | 12/1946 | United Kingdom | 81/440 |
| 9417960 | 8/1994 | WIPO | 81/440 |

*Primary Examiner*—David Scherbel
*Assistant Examiner*—Joni B. Danganan
*Attorney, Agent, or Firm*—Goodman & Teitelbaum, Esqs.

[57] ABSTRACT

A multifunctional pocket tool, for example a Swiss army knife, folding pen knife or knife-pliers, has at least one retractable implement and includes removable screwing attachments, for example Phillips attachments, flat screwdrivers, socket wrench or socket keys or corkscrews, which can be fixed perpendicularly to one of the lateral faces of the tool. The attachments are preferably attached by using a hexagonal opening in one side of the tool. The location of the opening is selected so as not to impede the manipulation of other implements. In one variant, a ratchet is integrated in the pocket tool. The ratchet is not reversible, but the attachments can be attached by using the two sides of the ratchet. A handle, serving normally to operate another implement, also enables operation of the ratchet. A removable adapter can be placed on a little screwdriver for fixing other removable screwing attachments.

7 Claims, 3 Drawing Sheets

MUTIFUNCTIONAL TOOL ABLE TO RECEIVE REMOVABLE ATTACHMENTS

Figure 1:
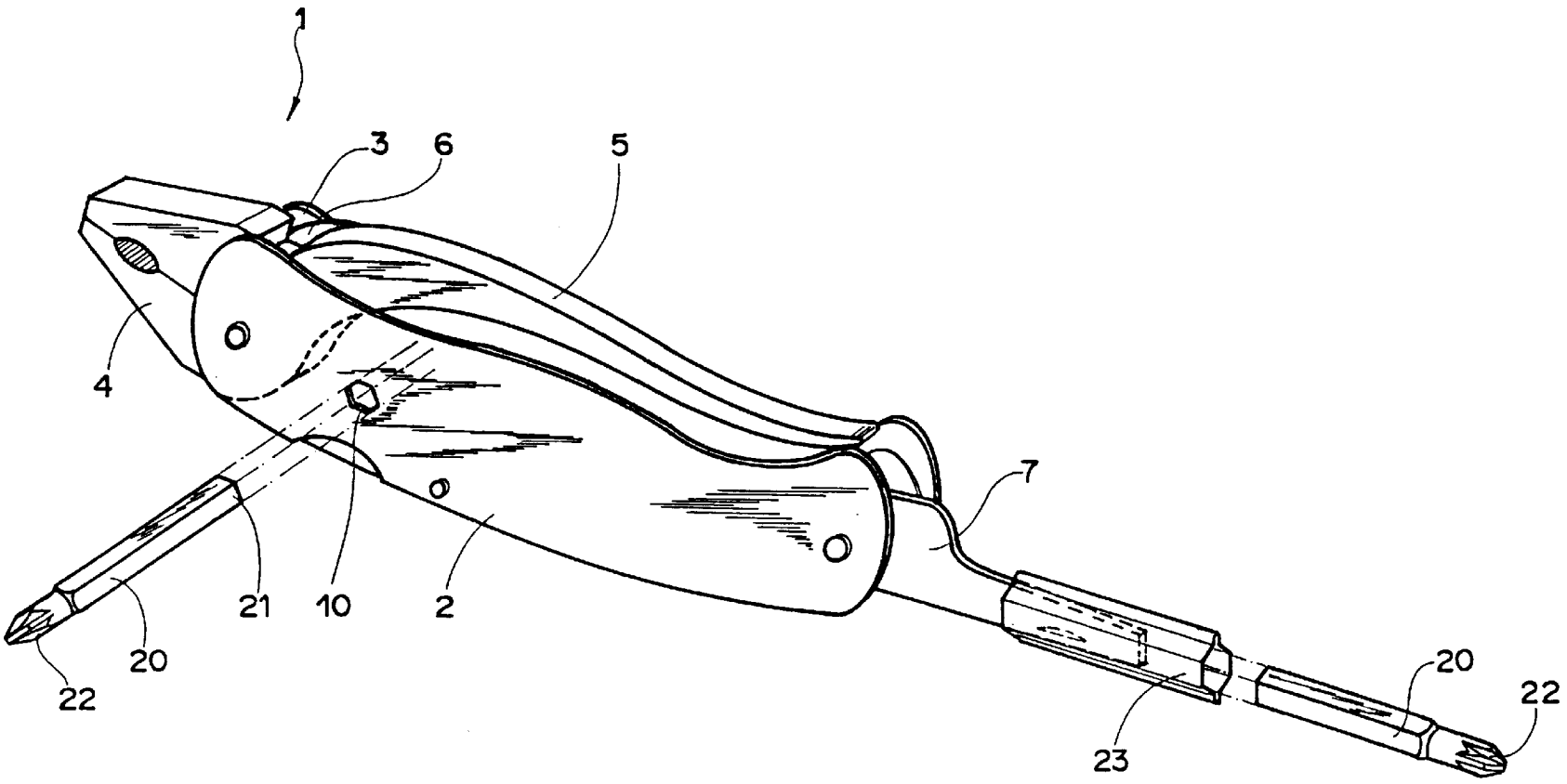

This invention relates to a multifunctional tool, and preferably to a multifunctional pocket tool. Understood here by multifunctional pocket tool are, for example, multifunctional pocket knives, of the Swiss army knife type, the versatile pen knife type, or knives which close. The invention applies as well to sliding blade knives, such as knives having a catch, knife-pliers or versatile pocket pliers.

In classic multifunctional pocket knives, such as Swiss army knives, the screwdrivers are generally not detachable. It is therefore necessary to provide a large number of different kinds of screwdrivers on the knife. It is however impossible to provide as many screwdrivers as desired. Moreover it is difficult to integrate large-sized Phillips screwdrivers into the knife owing to their large thickness which takes up the space of several conventional tools.

Knives and/or multifunctional pliers are known which have, among other implements, a pivoting attachment head specially adapted for insertion of standardized attachments of the screwdriver type or socket key type, for example. These attachments are standardized and, depending upon their type, can likewise be used, for example, in ratchet sets or in combination with screwdriving machines or with drilling-screwdriving machines. It is thus possible to use several types of detachable screwdrivers or keys with a single tool. In these knives, an attachment head is provided specifically for insertion of the attachments. This attachment head occupies a large thickness in the knife and does not fulfil any other functions.

In the prior art devices, the screwdrivers are deployed or are inserted in the longitudinal prolongation of the knife or pliers, and thus occupy a place which could be used for the placement of other implements. Moreover with such a placement of the screwdriver, the force which can be applied is generally insufficient, and manipulating the screwdriver, by taking the knife vertically in the hand, is difficult. This is also the case for the multifunctional knives described in the patents U.S. Pat. No. 5,280,659 (Kim et al.) and U.S. Pat. No. 4,995,128 (Montgomery).

In addition, in many of the prior art devices, there is the risk that the screwdriver or the attachment head is bent back toward the inside of the knife and injures the user, unless supplementary devices have been provided which increase the cost of the knife.

The patent CH 654 514 (Victorinox) discloses a multifunctional knife in which a detachable screwdriver can be inserted and maintained by the threads of the corkscrew. This solution is relatively costly to realize and is only suitable for small screwdrivers.

The patent GB 583,611 (Phillips) describes a multifunctional tool in which removable attachments can be inserted and maintained by an aperture in the sides of the tool. The body of the tool serves as the handle for manipulating the removable attachments. To insert an attachment, it is necessary beforehand to retract all the implements of the multifunctional tool. Thus this tool is very inconvenient to handle. At the same time this solution is dangerous when applied to multifunctional tools having blades or blunt instruments.

One object of the invention is to propose a multifunctional pocket tool not having the mentioned drawbacks of the prior art.

In particular the object of this invention is to propose a multifunctional pocket tool which is able to be equipped with attachments, for example screwdrivers, which are removable and preferably standardized.

Another object is to propose a multifunctional pocket tool able to be equipped with removable attachments, for example removable screwdrivers, and which leaves a maximum of space left for other implements.

Another object of this invention is to propose a multifunctional pocket tool in which removable attachments can be inserted with no risk of their being bent back and injuring the user.

Still another object of the invention is to propose a multifunctional pocket tool in which the removable screwdriver attachments can be inserted and maintained securely and firmly, so as to enable large moments to be applied to the screwdriver.

These objects are attained through the features of the present invention.

In particular, these objects are attained by equipping the lateral faces of the pocket tool with fixing means permitting removable attachments to be fixed extending perpendicularly to said lateral faces.

In fact, there is often nothing on the lateral faces of a pocket tool except an insignia or advertising. Thus the fixing means do not take up a space which could be used for another implement.

Moreover this placement allows the body of the pocket tool to be used as a handle for the screwing tool perpendicular to the axis of screwing, and thus allows screwing moments of large magnitude to be applied with easier handling.

The screwing implement can be introduced preferably through an aperture in one of the lateral faces of the tool, said aperture having a shape which prevents the pivoting of the screwing implement and ensures lateral hold of the implement in such a way that the end of the screwing implement rests on the inner side of the other face which ensures axial hold of the implement.

Said aperture is provided preferably at a place where it does not impede the normal pivoting or sliding of the other implement or implements of the pocket tool.

In a variant, the fixing means are integrated in a ratchet.

Figure 2:
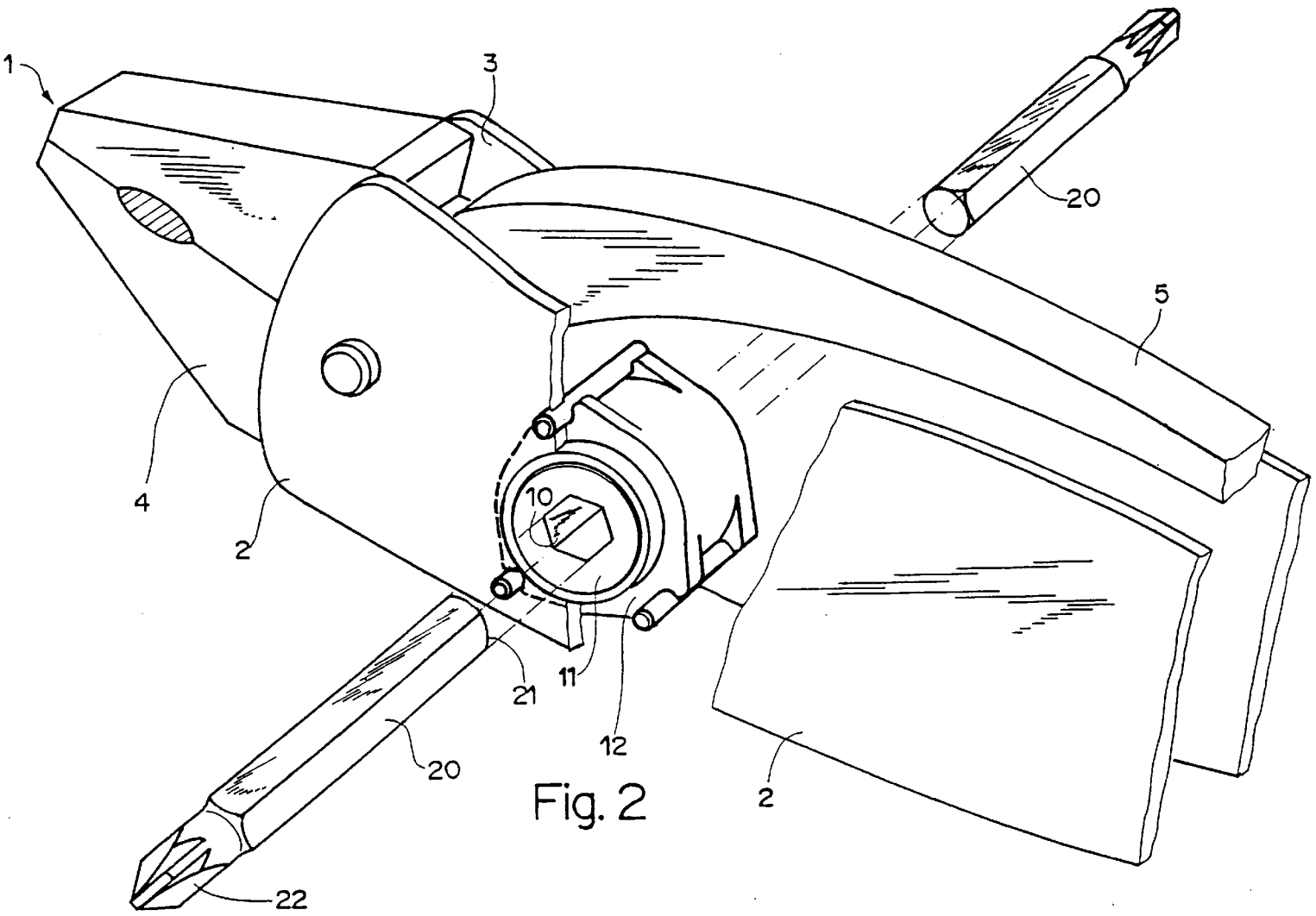
Figure 3:
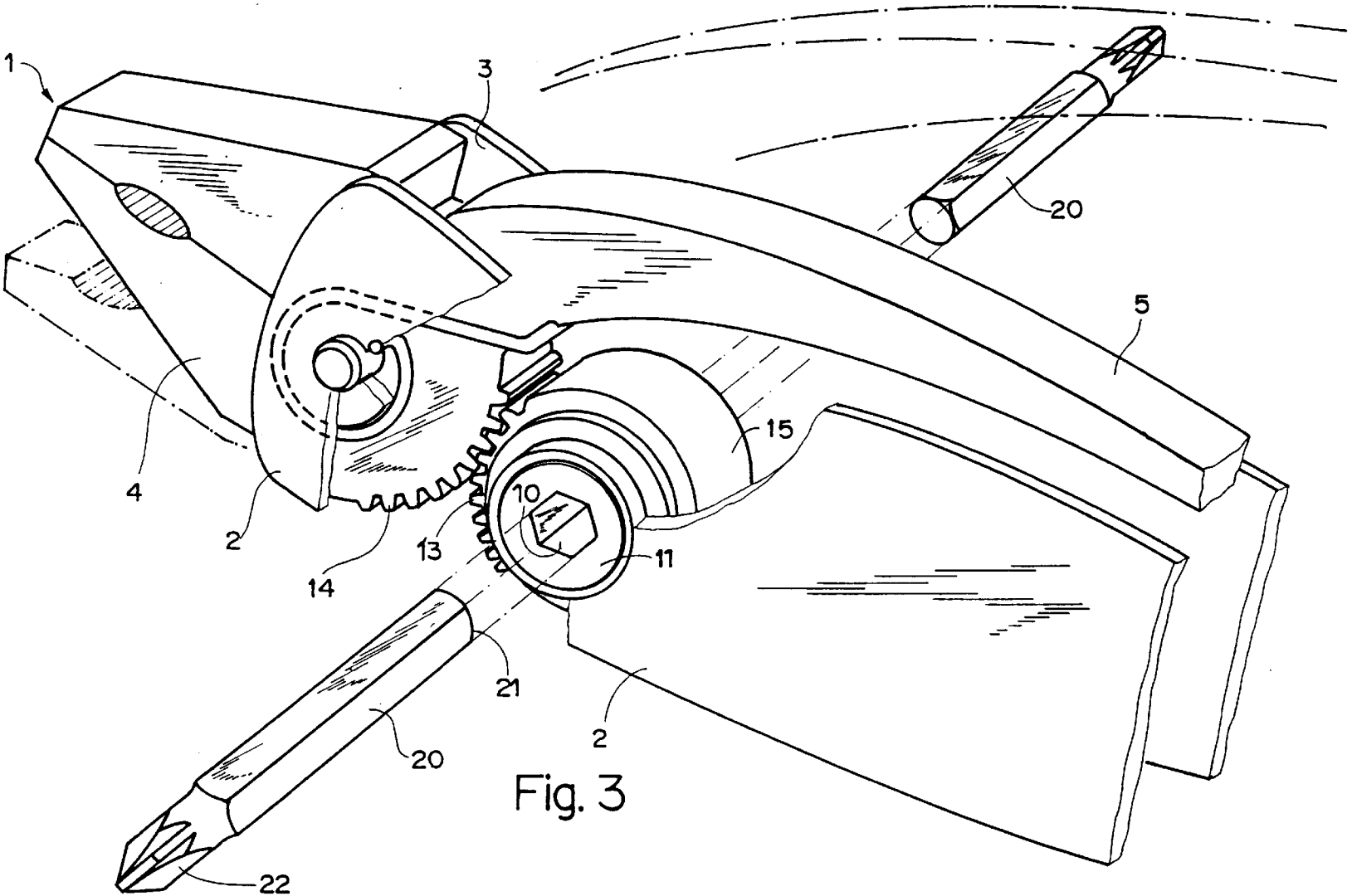

Other objects and advantages of the invention will become apparent from the following description of embodiments of the invention, presented by way of example, and illustrated by FIGS. 1 to 3, which are:

FIG. 1, a view of the knife-pliers assembly according to the invention in a first embodiment;

FIG. 2, a detailed view of the knife-pliers according to a second embodiment, including a ratchet function;

FIG. 3, a detailed view of the knife-pliers according to a third embodiment, including a ratchet function which can be operated by the handle of the pliers.

FIG. 1 shows a first variant of the invention applied to a knife-pliers 1. The knife-pliers include a universal pliers 4 in which one of the jaws is fixed and the other can be put into action by means of a handle of pliers 5 accommodated between the two sides 2, 3 of the knife-pliers. Other implements, for example a blade of the large knife 6 and a small screwdriver 7 are likewise accommodated between the sides of the knife and can be pulled out by making them pivot, as in ordinary folding pen knives. The sides 2, 3 of the knife are preferably of metal possibly covered with a molded or injected synthetic material. They can also be, however, of any other material, for example, horn, wood, etc., depending upon the aesthetic look one wishes to give the knife. In a general way, the two sides 2, 3 have parallel inner faces, between which the multiple implements are arranged parallel, and outer faces adapted ergononomically to the hand of the user, for example symmetrical.

In a variant, one or more implements can be pulled out by making them slide between the two inner faces of sides 2 and 3, as in the known knives having a catch. The invention applies, however, to any type of versatile tool having one or more retractable implements. In particular the invention also applies to collapsible pliers having jaws able to be folded up in hollow handles, such as described, for example, in the patent document U.S. Pat. No. 4,888,869. The faces of the hollow handles of this type of pliers are analogous and equivalent to sides of folding pen knives.

Side 2 of the knife-pliers is provided with a hexagonal aperture 10 in which a standardized attachment 20 can be introduced and maintained. The end 21 of the attachment opposite the head 22 touches the inner face of side 3. Thus side 2, which is provided with the aperture 10, ensures the hold laterally and in rotation of the attachment 20 whereas the opposite side 3 ensures its axial hold.

The attachment 20 can be of any known type, for example, a socket wrench or socket key, flat screwdriver, Phillips screwdriver, etc. It is also possible to use types of attachments other than the screwing tools specifically mentioned, for example a corkscrew or an awl could also be adapted. The end 21 of the attachment is preferably standardized and corresponds to the aperture 10 in such a way that the attachment can be introduced effortlessly in the knife, but is nevertheless held tightly.

Side 2 can, if necessary, be reinforced in the vicinity of aperture 10 so as to withstand large moments which can be applied with the attachment 20. Alternatively, a sleeve (not shown) can be welded between the aperture 10 and the supporting point of end 21 on the inner face of side 3, the attachment being then inserted inside the sleeve.

Aperture 10 is preferably placed so that the attachment 20 can be introduced without impeding the operation of other implements 6, 7 or of the pliers 4, 5. In a variant not shown, the knife-pliers 1 can include a male piece instead of the aperture 10. This male piece extends perpendicularly toward the side 2 in such a way that a modified attachment, having at end 21 a female accommodation corresponding to said projection, can be introduced. A ball on a spring can be provided in a conventional way on the flanks of the male piece to keep the attachment in position. This variant allows the volume between the two faces 2, 3 to be totally freed up for supplementary implements, but may detract from the aesthetic appeal and the handiness, depending upon the type of tool to which it is applied. Of course other means are also conceivable for temporarily fixing an attachment 20 perpendicular to lateral faces 2, 3 of knife-pliers 1.

The various attachments 20 can be carried, for example, in a case made of leather or of cloth (not shown) for the knife-pliers. A middle pocket of the case could accommodate the knife-pliers 1 whereas one or more auxiliary pockets could allow a set of attachments 20 of different types to be carried. If the invention is applied to a tool having a large inner volume, for example a collapsible tool of the type described in the U.S. Pat. No. 4,888,869 having hollow extensions of the handles, a set of attachments could also be carried in one or more compartments inside the tool.

The set of attachments also has preferably an adapter 23 allowing an attachment 20 to be placed on an existing implement 7, for example on the little screwdriver. This adapter can be used for an attachment 20 which is less stressed. In this way a standard attachment 20 can be fixed on practically any existing knife 1.

FIG. 2 illustrates a costlier variant of the invention, in which the knife-pliers 1 has a ratchet 11, in which any attachment 20 can be inserted in the same way as described above. The ratchet 11, shown symbolically, has a hexagonal aperture 10 which runs preferably through the whole knife-pliers, from one face to the other. Welded or riveted reinforcements 12 on sides 2, 3 are provided if the thickness of these sides is insufficient to withstand the moment which can be applied with the ratchet.

In the variant shown, the ratchet is not equipped with means to reverse the direction of rotation. The user has the possibility, however, of using it to screw or unscrew depending upon the face 2, 3 from which attachment 20 is inserted. Attachment 20 is held axially inside the aperture 10 by any means, not shown, for example by a peripheral recess or by replacing the through hole with two blind holes from each side. In the same way as indicated above, aperture 10 can also be replaced with a male piece on which female attachments can be inserted. It is also possible to provide a reversible ratchet by means of a locking device on the other face.

FIG. 3 shows a third variant of the invention in which the ratchet 11 can be operated by the handle 5 of the pliers 4. To do this, the barrel 15 of the ratchet 11 is equipped on at least one part of its periphery with teeth 13 meshing with other teeth 14 on the handle 5. Operation of the handle 5, when it is pressed against the knife 1 to the closed position shown in FIG. 3, causes at the same time the closing of the pliers 4 and the rotation of the barrel 15 from its original starting position, which in turn causes the attachment 20 to rotate. When the user's grip on the handle is relaxed, spring means of any kind it back to the open position shown in FIG. 3, so that the teeth 14 are rotated therewith causing the teeth 13 and the barrel 15 to also rotate back to the original starting position thereof. However, conventional ratcheting means, well known in the ratchet art, are disposed between the inner driver part of the ratchet 11 (the inner driver part having the aperture 10 therein) and the outer barrel 15 in order to disengage the inner driver part when the barrel 15 is rotated back to its original starting position. Accordingly, the inner driver part does not rotate with the barrel 15 at this time, and thus, the attachment 20 also remaining immobile at that time. This variant achieves the greatest ease of use.

What is claimed is:

1. A multifunctional tool comprising:

first and second lateral sides being secured together to provide a handle for the multifunctional tool, a first inner face of said first lateral side facing and being substantially parallel to a second inner face of said second lateral side;

at least one non-removable implement being secured between said first and second lateral sides for being housed within said handle during non-use thereof, said non-removable implement including means to permit said non-removable implement to pivot or slide outwardly from said handle for use thereof, said non-removable implement moving in a first plane disposed between and parallel to said first and second inner faces;

removable attachments;

fixing means disposed on at least one of said first and second lateral sides for allowing said removable attachments to be disposed in a second plane and fixed perpendicularly to said first and second inner faces and also to said first plane without impeding any pivoting or sliding of said non-removable implement or any other implements secured between said first and second lateral sides and housed within said handle during non-use thereof;

said fixing means including aperture means in at least one of said first and second lateral sides for insertingly receiving a free end of any one of said removable attachments; and said aperture means being provided with a predetermined shape to impede any pivoting of any one of said removable attachments.

2. A multifunctional tool according to claim 1, wherein said aperture means is only disposed in said first lateral side to ensure a lateral hold of any one of said removable attachments with said free end thereof resting against said second inner face of said second lateral side to ensure an axial hold on said free end.

3. A multifunctional tool according to claim 1, wherein said fixing means includes a male piece extending perpendicularly to said first and second lateral sides, said male piece corresponding to a female accommodation disposed at an end of at least one of said removable attachments.

4. A multifunctional tool comprising:

first and second lateral sides being secured together to provide a handle for the multifunctional tool, a first inner face of said first lateral side facing and being substantially parallel to a second inner face of said second lateral side;

at least one non-removable implement being secured between said first and second lateral sides for being housed within said handle during non-use thereof, said non-removable implement including means to permit said non-removable implement to pivot or slide outwardly from said handle for use thereof, said non-removable implement moving in a first plane disposed between and parallel to said first and second inner faces;

removable attachments;

fixing means disposed on at least one of said first and second lateral sides for allowing said removable attachments to be disposed in a second plane and fixed perpendicularly to said first and second inner faces and also to said first plane without impeding any pivoting or sliding of said non-removable implement or any other implements secured between said first and second lateral sides and housed within said handle during non-use thereof;

said fixing means being integrated in a ratchet; and said ratchet including a barrel, handle means for operating said barrel, and means for allowing another implement to be operated by said handle means at the same time as said barrel.

5. A multifunctional tool according to claim 4, wherein said ratchet is reversible.

6. A multifunctional tool according to claim 4, wherein said ratchet is not reversible, and wherein at least one of said removable attachments can be fixed to said ratchet from either one of said first and second lateral sides.

7. A multifunctional tool comprising:

first and second lateral sides being secured together to provide a handle for the multifunctional tool, a first inner face of said first lateral side facing and being substantially parallel to a second inner face of said second lateral side;

at least one non-removable implement being secured between said first and second lateral sides for being housed within said handle during non-use thereof, said non-removable implement including means to permit said non-removable implement to pivot or slide outwardly from said handle for use thereof, said non-removable implement moving in a first plane disposed between and parallel to said first and second inner faces;

removable attachments;

fixing means disposed on at least one of said first and second lateral sides for allowing said removable attachments to be disposed in a second plane and fixed perpendicularly to said first and second inner faces and also to said first plane without impeding any pivoting or sliding of said non-removable implement or any other implements secured between said first and second lateral sides and housed within said handle during non-use thereof; and a removable adapter for placing on said non-removable implement, a free end of said removable adapter including means for fixing at least one of said removable attachments.

* * * * *